US008488953B2

(12) United States Patent
Nakashima et al.

(10) Patent No.: US 8,488,953 B2
(45) Date of Patent: Jul. 16, 2013

(54) FILAMENT LAMP

(75) Inventors: Akinobu Nakashima, Himeji (JP); Shinji Taniguchi, Himeji (JP)

(73) Assignee: Ushio Denki Kabushiki Kaisha, Tokyo-to (JP)

( * ) Notice: Subject to any disclaimer, the term of this patent is extended or adjusted under 35 U.S.C. 154(b) by 960 days.

(21) Appl. No.: 12/509,559

(22) Filed: Jul. 27, 2009

(65) Prior Publication Data

US 2010/0021147 A1 Jan. 28, 2010

(30) Foreign Application Priority Data

Jul. 28, 2008 (JP) ..... P2008-193234

(51) Int. Cl.
*A45D 20/40* (2006.01)

(52) U.S. Cl.
USPC ..... 392/407; 392/424; 313/626

(58) Field of Classification Search
None
See application file for complete search history.

(56) References Cited

U.S. PATENT DOCUMENTS

| | | | | |
|---|---|---|---|---|
| 3,211,826 | A * | 10/1965 | Holcomb et al. | 174/50.64 |
| 3,579,021 | A * | 5/1971 | Kimball | 313/274 |
| 3,634,722 | A * | 1/1972 | Palmer et al. | 313/279 |
| 3,678,319 | A * | 7/1972 | Notelteirs et al. | 313/271 |
| 3,736,455 | A * | 5/1973 | Notelteirs et al. | 313/274 |
| 4,442,374 | A * | 4/1984 | Morris et al. | 313/316 |
| 4,710,676 | A * | 12/1987 | Morris et al. | 313/579 |
| 5,877,590 | A * | 3/1999 | Fukuyo et al. | 313/623 |
| 6,411,037 | B1 * | 6/2002 | Ohkawai et al. | 313/623 |
| 6,713,949 | B2 * | 3/2004 | Fukushima et al. | 313/332 |
| 6,903,510 | B2 * | 6/2005 | Ohshima et al. | 313/634 |
| 7,639,930 | B2 * | 12/2009 | Mizukawa et al. | 392/416 |
| 7,781,951 | B2 * | 8/2010 | Tanino et al. | 313/338 |
| 8,014,652 | B2 * | 9/2011 | Suzuki et al. | 392/411 |
| 8,072,128 | B2 * | 12/2011 | Tanino et al. | 313/316 |
| 2002/0179859 | A1 * | 12/2002 | Takeji et al. | 250/503.1 |
| 2002/0185974 | A1 * | 12/2002 | Nakano et al. | 313/623 |
| 2002/0190653 | A1 * | 12/2002 | Takeji et al. | 313/623 |
| 2003/0111457 | A1 | 6/2003 | Tidrick | |
| 2006/0197454 | A1 * | 9/2006 | Mizukawa et al. | 315/46 |
| 2008/0050104 | A1 | 2/2008 | Mizukawa et al. | |
| 2008/0298787 | A1 * | 12/2008 | Suzuki et al. | 392/411 |
| 2009/0072741 | A1 * | 3/2009 | Kawasaki et al. | 313/621 |
| 2009/0243456 | A1 * | 10/2009 | Tanino et al. | 313/1 |
| 2009/0243461 | A1 * | 10/2009 | Nakashima et al. | 313/316 |
| 2010/0072876 | A1 * | 3/2010 | Nakashima et al. | 313/316 |

FOREIGN PATENT DOCUMENTS

| | | | |
|---|---|---|---|
| DE | 100 24 709 | A1 | 11/2001 |
| EP | 0 213 495 | A2 | 3/1987 |
| EP | 1 699 071 | A1 | 9/2006 |

(Continued)

*Primary Examiner* — Thor Campbell
(74) *Attorney, Agent, or Firm* — Drinker Biddle & Reath LLP

(57) ABSTRACT

A filament lamp is provided. The filament lamp includes: a long light emitting section including a plurality of filaments aligned with one another in an axial direction of the light emitting section, wherein electric power is independently supplied to each of the filaments; a sealing section that seals the light emitting section, including: a first sealing section provided at one end of the light emitting section; and a second sealing section provided at the other end of the light emitting section; a plurality of metal foils embedded in the sealing section; a plurality of external leads each connected to a corresponding one of the metal foils and extending from the sealing section to the outside; and a plurality of glass pipes each provided on the sealing section so as to cover a corresponding one of the external leads.

9 Claims, 3 Drawing Sheets

FOREIGN PATENT DOCUMENTS

| | | | |
|---|---|---|---|
| EP | 1 770 758 | A2 | 4/2007 |
| FR | 1489101 | | 7/1967 |
| JP | 57-119451 | | 7/1982 |
| JP | 59-66048 | | 4/1984 |
| JP | 62-67446 | | 4/1987 |
| JP | HEI 1-161548 | | 11/1989 |
| JP | 9-92214 | | 4/1997 |
| JP | 10-106511 | | 4/1998 |
| JP | 2001-210280 | | 8/2001 |
| JP | 2006/279008 | | 10/2006 |
| JP | 2008/53035 | | 3/2008 |
| JP | 2008-59949 | | 3/2008 |

* cited by examiner

FILAMENT LAMP

This application claims priority from Japanese Patent Application No. 2008-193234, filed on Jul. 28, 2008, the entire contents of which are hereby incorporated by reference.

BACKGROUND OF THE INVENTION

1. Technical Field

Devices and apparatuses consistent with the present invention relate to filament lamps, and, in particular, to filament lamps used for heating an object to be treated.

2. Related Art

In the process for manufacturing a solar cell, there are a thermal diffusion process for diffusing P-type semiconductors and a firing process for firing silver paste that is used as an electrode material. In the both processes, a semiconductor wafer or a glass substrate is heated to a high temperature, for example, 800 to 900° C. by using a thermal diffusion furnace and a firing furnace.

Meanwhile, this heat treatment device should uniformly heat the object to be treated to prevent difference in temperature according to location. For this reason, there has been proposed a filament lamp that is used as a light source, has a plurality of power supply paths in an arc tube, and can independently supply desired electric power to respective paths (see e.g., JP-A-2006-279008).

Further, since such a filament lamp has a plurality of power supply paths in the arc tube, terminals whose number corresponds to the number of the power supply paths should be provided to sealing sections of the lamp.

However, since the heating temperature of the object is higher in the above-mentioned process for manufacturing a solar cell, the electric power to be supplied to the lamp has also been increased. Meanwhile, there is a high demand for miniaturization rather in its size as opposed to an increase. That is, there is a demand for a filament lamp that has a plurality of independent power supply structures and meets the high input without the increase in size.

SUMMARY OF THE INVENTION

Exemplary embodiments of the present invention address the above disadvantages and other disadvantages not described above. However, the present invention is not required to overcome the disadvantages described above, and thus, an exemplary embodiment of the present invention may not overcome any of the disadvantages described above.

Accordingly, it is an aspect of the present invention to provide a filament lamp that has a plurality of independent power supply paths and meets the high input without the increase in size.

According to one or more aspects of the present invention, a filament lamp is provided. The filament lamp includes: a long light emitting section including a plurality of filaments aligned with one another in an axial direction of the light emitting section, wherein electric power is independently supplied to each of the filaments; a sealing section that seals the light emitting section, including: a first sealing section provided at one end of the light emitting section; and a second sealing section provided at the other end of the light emitting section; a plurality of metal foils embedded in the sealing section; a plurality of external leads each connected to a corresponding one of the metal foils and extending from the sealing section to the outside; and a plurality of glass pipes each provided on the sealing section so as to cover a corresponding one of the external leads.

According to one or more aspects of the present invention, there is provided a heat treatment device including the filament lamp.

DETAILED DESCRIPTION OF EXEMPLARY EMBODIMENTS

Exemplary embodiments of the present invention will be now described with reference to the drawings.

Figure 1:
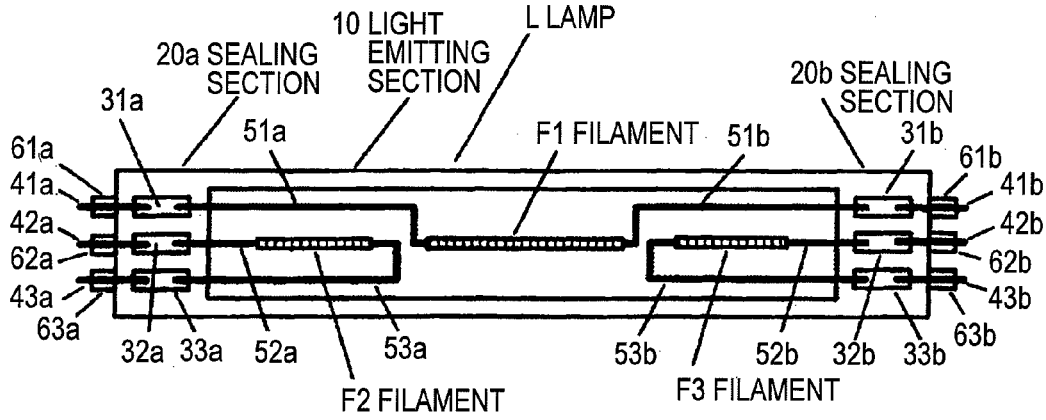
FIG. 1 is a view showing the entire configuration of a filament lamp according to an exemplary embodiment of the invention.

FIG. 1 is a view showing the entire configuration of a filament lamp according to an exemplary embodiment of the invention.

A lamp L includes a long light emitting section 10, and sealing sections 20 (20*a* and 20*b*) that are formed at both ends of the light emitting section 10. The lamp L has a tubular shape as a whole. An airtight space is formed in the light emitting section 10, and the light emitting section 10 is provided with a plurality of filaments F (F1, F2, and F3) that extends in the axial direction of the light emitting section 10. The filaments F1, F2, and F3 are completely electrically isolated from one another. Specifically, the filament F1 is disposed in the middle of the light emitting section 10, the filament F2 is disposed at one end of the light emitting section 10 (at the end close to the sealing section 20*a*), and the filament F3 is disposed at the other end of the light emitting section 10 (at the end close to the sealing section 20*b*). The filaments F1, F2, and F3 are aligned with one another so as to parallel to the central axis of the light emitting section 10.

Metal foils 30 (31*a*, 32*a*, 33*a*, 31*b*, 32*b*, and 33*b*), which correspond to the number of the filaments F, are embedded in the sealing sections 20 (20*a* and 20*b*). Specifically, the metal foil 31*a* corresponding to the filament F1, the metal foil 32*a* corresponding to the filament F2, and the metal foil 33*a* corresponding to the filament F2 are embedded in the sealing section 20*a*. Further, the metal foil 31*b* corresponding to the filament F1, the metal foil 32*b* corresponding to the filament F3, and the metal foil 33*b* corresponding to the filament F3 are embedded in the sealing section 20*b*.

External leads 40 (41*a*, 42*a*, 43*a*, 41*b*, 42*b*, and 43*b*) extending outside the lamp and internal leads 50 (51*a*, 52*a*, 53*a*, 51*b*, 52*b*, and 53*b*) extending inside the light emitting section 10 are connected to the metal foils 30. Specifically, the external lead 41*a* and the internal lead 51*a* are connected to the metal foil 31*a*, the external lead 42*a* and the internal lead 52*a* are connected to the metal foil 32*a*, and the external lead 43*a* and the internal lead 53*a* are connected to the metal foil 33*a*. Further, the external lead 41*b* and the internal lead 51*b* are connected to the metal foil 31*b*, the external lead 42*b* and the internal lead 52*b* are connected to the metal foil 32*b*, and the external lead 43*b* and the internal lead 53*b* are connected to the metal foil 33*b*.

Accordingly, one independent conduction path is formed of the external lead 41*a*, the metal foil 31*a*, the internal lead 51*a*, the filament F1, the internal lead 51*b*, the metal foil 31*b*, and the external lead 41*b*. Predetermined electric power is supplied to the external lead 41*a* and the external lead 41*b*, so that the filament F1 emits light. Likewise, one independent conduction path is formed of the external lead 42*a*, the metal foil 32*a*, the internal lead 52*a*, the filament F2, the internal lead 53*a*, the metal foil 33*a*, and the external lead 43*a*. Predetermined electric power is supplied to the external lead 42*a* and the external lead 43*b*, so that the filament F2 emits light. In addition, one independent conduction path is formed of the external lead 42*b*, the metal foil 32*b*, the internal lead 52*b*, the filament F3, the internal lead 53*b*, the metal foil 33*b*, and the external lead 43*b*. Predetermined electric power is supplied to the external lead 42*b* and the external lead 43*b*, so that the filament F3 emits light.

As described above, in the filament lamp according to this embodiment, the external lead 42*a* and the external lead 43*a*, which correspond to the filament F2 and disposed at one end of the light emitting section 10, are formed so as to protrude from the sealing section 20*a* that is close to the filament F2, and two external leads 42*b* and 43*b*, which correspond to the filament F3 and disposed at the other end of the light emitting section 10, are formed so as to protrude from the sealing section 20*b* that is close to the filament F3.

In the filament lamp, for example, electric power of 3 kW is supplied to the filament F1 disposed in the middle of the light emitting section 10, and electric power of 600 W is supplied to the filaments F2 and F3 disposed at the ends of the light emitting section 10. Meanwhile, the filaments F1, F2, and F3 may be turned on at the same time, but a part of filaments may be turned on and the other filaments may be turned off.

The filaments F are formed by closely winding, for example, a tungsten wire in the shape of a coil. An inert gas, such as argon (Ar) or nitrogen ($N_2$), is enclosed in the light emitting section 10 together with halogen, such as bromine (Br) or chlorine (Cl). Meanwhile, although not shown, anchors for supporting the filaments F or the internal leads 50 may be provided. The internal leads 50 may be coated with insulating members. The structure of the filament lamp according to the exemplary embodiment of the invention is referred to European Patent Application No. 09003532.0, filed on Mar. 11, 2009, which has been filed by this applicant.

Figure 2:
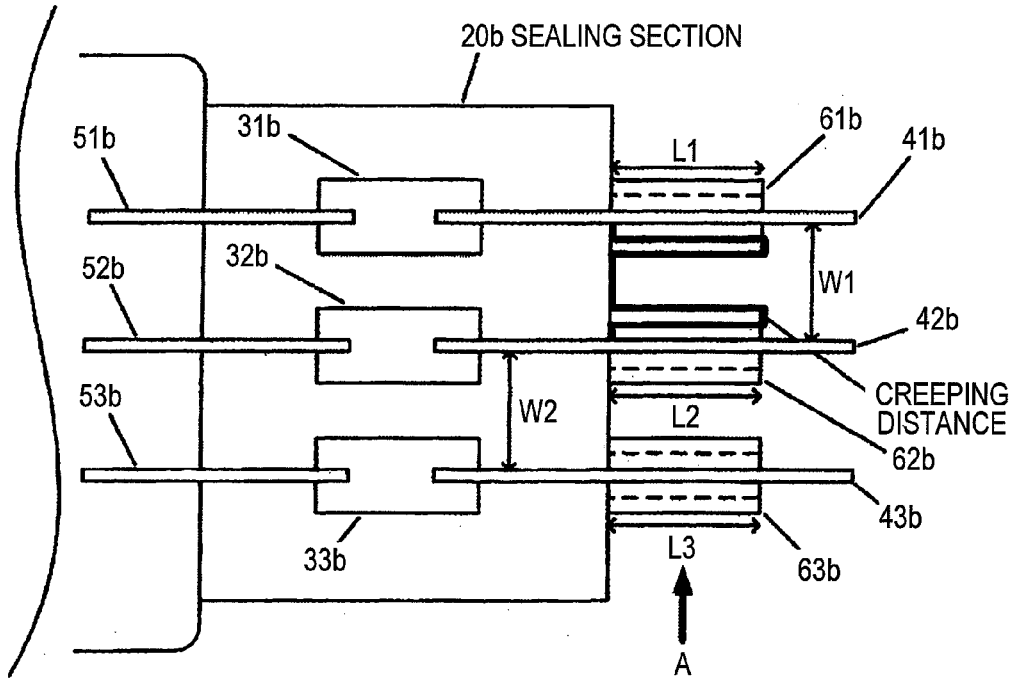
FIG. 2 is a view showing the configuration of a sealing section of the filament lamp according to the exemplary embodiment of the invention.

FIG. 2 is an enlarged view of the sealing section 20*b*, when seen in the same direction as FIG. 1. Glass pipes 60 (61*b*, 62*b*, and 63*b*) are fixed to the external leads 40 (41*b*, 42*b* and 43*b*), respectively. Since the glass pipes 60 are formed so as to cover the external leads 40 without coming in contact with the outer surfaces of the external leads 40, the creeping distance between adjacent external leads 40 is increased. Specifically, as shown in the figure, the creeping distance between the external lead 41*b* and the external lead 42*b* is substantially equal to the sum of the length twice as long as the length L1 of the external lead 41*b* (the length of a discontiguous portion) in the glass pipe 61*b* in the longitudinal direction, the length twice as long as the length L2 of the external lead 42*b* (the length of a discontiguous portion) in the glass pipe 62*b*, and the separation distance W1 between the external leads 41*b* and 42*b* in the direction orthogonal to the extending direction of each external lead. Likewise, the creeping distance between the external lead 42*b* and the external lead 43*b* is substantially equal to the sum of the length twice as long as the length L2 of the external lead 42*b* (the length of the discontiguous portion) in the glass pipe 62*b* in a longitudinal direction, the length twice as long as the length L3 of the external lead 43*b* (the length of the discontiguous portion) in the glass pipe 63*b*, and the separation distance W2 between the external leads 42*b* and 43*b* in the direction orthogonal to the extending direction of each external lead. Accordingly, for example, even though high electric power of 3 kW is supplied to the filament as described above, the creeping distance between the external leads is increased. Therefore, it may be possible to effectively prevent creeping discharge.

Figure 3:
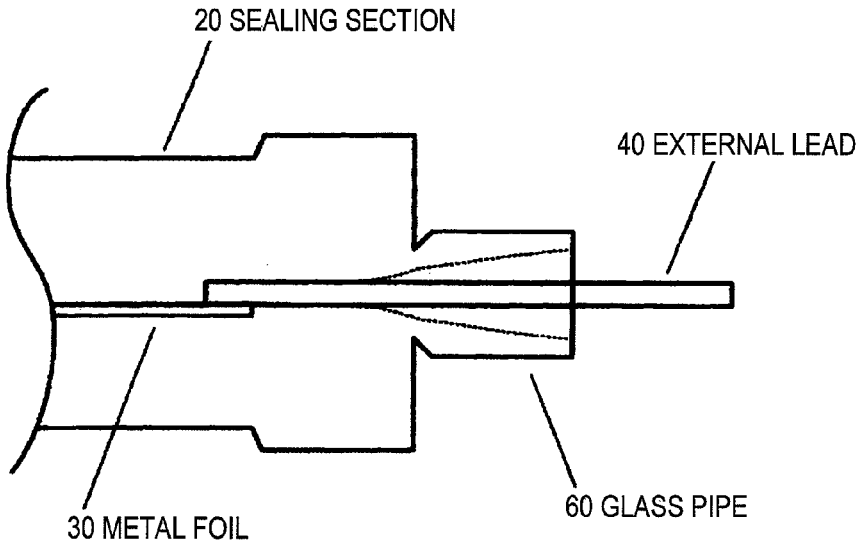
FIG. 3 is a view showing the configuration of the sealing section of the filament lamp according to the exemplary embodiment of the invention.

FIG. 3 is a partially enlarged view of the sealing section 20, when seen in the direction that is indicated by the arrow "A" shown in FIG. 2. The glass pipe 60 is provided so as to correspond to the external lead 40 that protrudes from the end of the sealing section 20. Meanwhile, in FIG. 3, the metal foil 30, the external lead 40, and the glass pipe 60 are provided side by side in a vertical direction of a plane of paper. The inner surface of the glass pipe 60 is separated from the external lead 40 without coming in contact with the external lead.

In the case of the so-called "both-ends sealed filament lamp" including a long light emitting section (see e.g., JP-A-2001-210280), only one external lead protrudes from one sealing section. Therefore, a problem that creeping discharge occurs between adjacent external leads does not exist. Further, in the case of the so-called "one-end sealed filament lamp" including only one sealing section (see e.g., FIG. 5 of JP-UM-A-1-161548), two external leads protrude from one sealing section. However, since this structure merely corresponds to the external leads that form the same power supply path and the difference in potential is small, the problem the creeping discharge occurs does not exist. Meanwhile, since at least three terminals (external leads), which form an independent power supply path, are formed side by side in one sealing section of the filament lamp according to the exemplary embodiment, the creeping discharge between adjacent external leads is very critical. Accordingly, exemplary embodiments of the invention are particularly applied to a filament lamp where at least three external leads are formed in one sealing section and plural independent power supply paths are formed.

In addition, in the filament lamp according to the exemplary embodiment, as described above, the end of the glass pipe 60 facing the sealing section 20 is integrally pinched and sealed together with the material that forms the sealing section 20. Accordingly, quartz glass forming the glass pipe 60 and quartz glass forming the sealing section 20 are melted and substantially integrated with each other. That is, if a recess is formed at the sealing section 20 and a glass pipe is inserted into the recess, there is a possibility that creeping discharge occurs in the gap generated between the pipe and the recess. However, since the above-mentioned gap is not formed in the exemplary embodiment of the invention, it may be possible to completely prevent the creeping discharge generated in the gap.

Examples of numerical values for the filament lamp are as follows: the length of the sealing section 20 in width is in a range of about 13 mm to about 18 mm, for example, 18 mm. The separation distance W between the adjacent external leads 40 is in a range of about 5 mm to about 7 mm, for example, 6 mm. Further, the length L of the external lead (the length of a discontiguous portion) covered by the glass pipe 60 in the longitudinal direction (in the axial direction) is in a range of about 5 mm to about 15 mm, for example, 10 mm. The outer diameter of the glass pipe 60 is ϕ13 mm, and the inner diameter of the glass pipe 60 is ϕ10.5 mm. Accordingly, the creeping distance is, for example, 26 mm.

Figure 4:
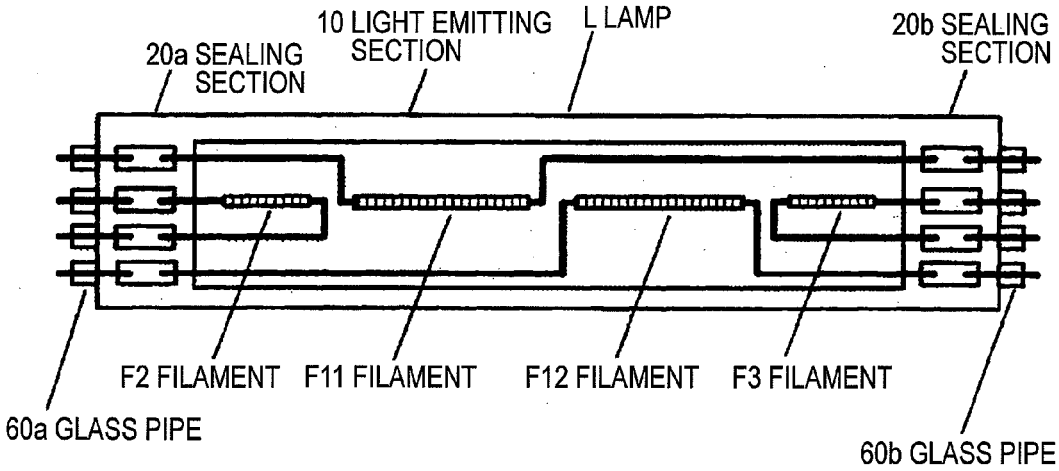
FIG. 4 is a view showing a filament lamp according to another exemplary embodiment of the invention.

FIG. 4 is a view showing a filament lamp according to another exemplary embodiment of the invention. The filament lamp shown in FIG. 1 includes three filaments to which electric power may be independently supplied, but the filament lamp shown in FIG. 4 includes four filaments. This is the difference between the filament lamps. Filaments F11 and F12 are disposed in the middle of a light emitting section 10, a filament F2 is disposed at one end of the light emitting section 10 (at the end close to a sealing section 20*a*), and a filament F3 is disposed at the other end of the light emitting section 10 (at the end close to a sealing section 20*b*). The filaments F11, F12, F2, and F3 are aligned with one another so as to be parallel to the central axis of the light emitting section 10. Even in the case of the filament lamp having the above-mentioned structure, glass pipes having the structure as shown in FIGS. 2 and 3 are formed at external leads that protrude from the sealing sections 20. Meanwhile, the filament lamp including four filaments is also referred to FIG. 4 of European Patent Application No. 09003532.0, which has been filed by this applicant.

Figure 5:
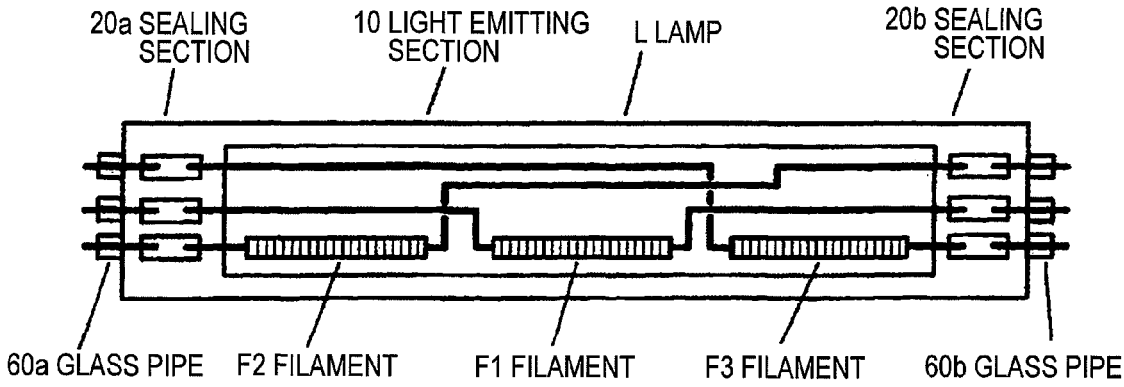
FIG. 5 is a view showing a filament lamp according to still another exemplary embodiment of the invention.

FIG. 5 is a view showing a filament lamp according to another exemplary embodiment of the invention. In the filament lamp shown in FIG. 1 or 4, the external leads, which correspond to the filament disposed in the vicinity of one sealing section 20, are protruded outwards from the sealing section 20. However, in the exemplary embodiment, a plurality of external leads provided at one sealing section 20 corresponds to different filaments, respectively. Specifically, three metal foils embedded in the sealing section 20*a* correspond to filaments F1, F2, and F3, respectively. Further, three metal foils embedded in the sealing section 20*b* correspond to the filaments F1, F2, and F3, respectively. Accordingly, as seen from the filaments, one terminal of each of all filaments protrudes from the sealing section 20*a* and the other terminal thereof protrudes from the sealing section 20*b*. Even in the case of the filament lamp of this structure, glass pipes of the structure shown in FIGS. 2 and 3 are provided to the external leads that protrude from the sealing sections 20. Meanwhile, only two filaments may be provided in the case of this structure.

Figure 6:
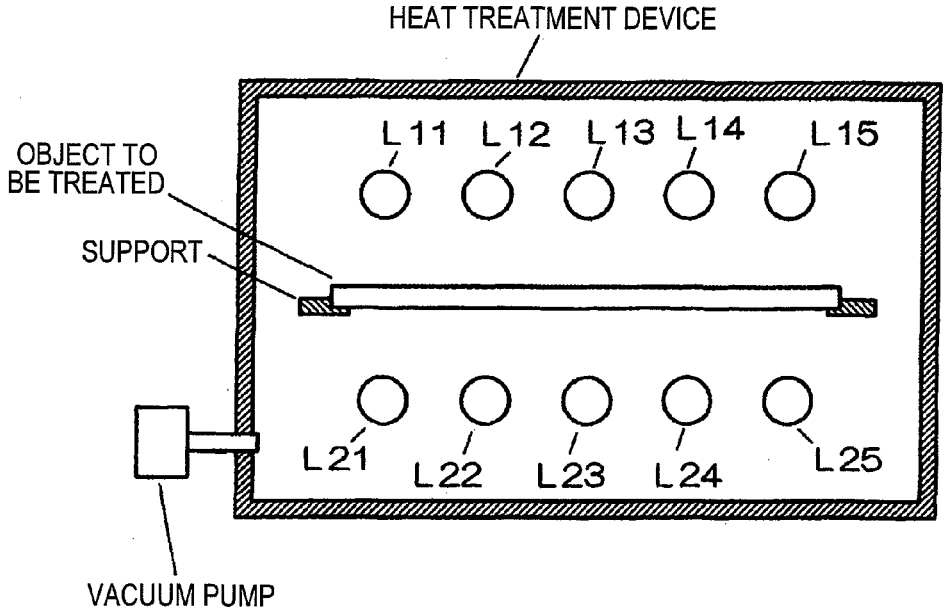
FIG. 6 is a view showing a heat treatment device that uses the filament lamp according to the exemplary embodiment of the invention.

FIG. 6 is a schematic view showing a heat treatment device that uses the filament lamp according to the exemplary embodiment of the invention.

An object to be treated is disposed in the heat treatment device (chamber). Further, filament lamps L1 (a lamp L11, a lamp L12, a lamp L13, a lamp L14, and a lamp L15) are disposed so as to face the front surface of the object. Furthermore, filament lamps L2 (a lamp L21, a lamp L22, a lamp L23, a lamp L24, and a lamp L25) are disposed so as to face the back surface of the object. A vacuum pump is connected to the heat treatment device, so that the inner space of the heat treatment device is maintained in a reduced-pressure atmosphere. Also, the object is held by support.

If the lamp is disposed in the reduced-pressure atmosphere as described above, the external lead cannot be coated with an insulator or the like. For this reason, it is useful to employ the glass pipe according to the exemplary embodiment of the invention. Furthermore, under the reduced-pressure atmosphere, the creeping discharge is generally likely to occur in the atmosphere of specific pressure by Paschen's Law. In the case of the filament lamp according to the exemplary embodiment of the invention, the creeping discharge is likely to occur in the atmospheric pressure of, for example, about 3 Pa to about 2000 Pa. For this reason, the glass pipe is useful.

In the exemplary embodiment of the invention, "metal foils corresponding to the number of filaments" does not mean that the number of filaments is necessarily equal to the number of metal foils. For example, the filament F1 shown in FIG. 1 may be divided into a plurality of filaments in the longitudinal direction.

While the present invention has been shown and described with reference to certain exemplary embodiments thereof, it will be understood by those skilled in the art that various changes in form and details may be made therein without departing from the spirit and scope of the invention as defined by the appended claims. It is aimed, therefore, to cover in the appended claim all such changes and modifications as fall within the true spirit and scope of the present invention.

What is claimed is:

1. A filament lamp comprising:

a long light emitting section comprising a plurality of filaments aligned with one another in an axial direction of the light emitting section, wherein electric power is independently supplied to each of the filaments;

a sealing section that seals the light emitting section, comprising:

a first sealing section provided at one end of the light emitting section; and a second sealing section provided at the other end of the light emitting section;

a plurality of metal foils embedded in the sealing section;

a plurality of external leads each connected to a corresponding one of the metal foils and extending from the sealing section to the outside; and a plurality of glass pipes each provided on the sealing section and formed to cover a corresponding one of the external leads without coming into contact with an outer surface of the corresponding one of the external leads.

2. The filament lamp according to claim 1, wherein the glass pipes are integrally sealed together with the sealing section.

3. The filament lamp according to claim 1, wherein the number of the metal foils embedded in either the first sealing section or the second sealing section corresponds to the number of the filaments.

4. The filament lamp according to claim 1, wherein the metal foils are aligned with each other in a direction orthogonal to the axial direction.

5. The filament lamp according to claim 1, wherein a separation distance between the adjacent external leads is in a range of about 5 mm to about 7 mm, and the length of the external leads covered by the glass pipes in the axial direction is in a range of about 5 mm to about 15 mm.

6. The filament lamp according to claim 2, wherein the light emitting section comprises at least three filaments, wherein a first one of the filaments is disposed near the first sealing section, and two external leads corresponding to the first one of the filaments extend from the first sealing section to the outside, and wherein a second one of the filaments is disposed near the second sealing section, and two external leads corresponding to the second one of the filaments extend from the second sealing section to the outside.

7. A heat treatment device comprising:

the filament lamp according to claim 1, which is provided inside the heat treatment device;

a vacuum pump is connected to the heat treatment device, wherein the inside of the heat treatment device is kept in an atmospheric pressure of about 3 Pa to about 2000 Pa.

8. The filament lamp according to claim 1, wherein the filament lamp is used in an atmospheric pressure of about 3 Pa to about 2000 Pa.

9. A heat treatment device comprising:

the filament lamp according to claim 8 which is provided inside the heat treatment device;

a vacuum pump is connected to the heat treatment device, wherein the inside of the heat treatment device is kept in the atmospheric pressure of about 3 Pa to about 2000 Pa.

* * * * *